US005413372A

United States Patent [19]

Evans et al.

[11] Patent Number: 5,413,372

[45] Date of Patent: May 9, 1995

[54] PIVOTAL AND ADJUSTABLE SLALOM MONASKI BINDING

[75] Inventors: Robert M. Evans, Hornell; Franklin G. Miller, Orchard Park, both of N.Y.

[73] Assignee: Evans Slalom Ski Binding Company, Hornell, N.Y.

[21] Appl. No.: 43,495

[22] Filed: Apr. 6, 1993

[51] Int. Cl.[6] ..... A63C 9/085

[52] U.S. Cl. ..... 280/620; 280/633; 280/636; 280/14.2

[58] Field of Search ..... 280/14.2, 607, 615, 280/620, 633, 636, 618

[56] References Cited

U.S. PATENT DOCUMENTS

| | | | |
|---|---|---|---|
| 2,116,985 | 5/1938 | Sprague et al. . | |
| 3,477,736 | 11/1969 | Unger | 280/633 |
| 3,936,063 | 2/1976 | Sittmann | 280/620 |
| 3,950,000 | 4/1976 | Sittmann | 280/636 |
| 4,008,908 | 2/1977 | Pierson | 280/607 X |
| 4,652,007 | 3/1987 | Dennis | 280/14.2 X |
| 5,028,068 | 7/1991 | Donovan | 280/14.2 X |
| 5,054,807 | 10/1991 | Fauvet | 280/14.2 X |
| 5,261,689 | 11/1993 | Carpenter et al. | 280/633 X |

FOREIGN PATENT DOCUMENTS

| | | | |
|---|---|---|---|
| 858446 | 11/1940 | France | 280/636 |
| 1336175 | 7/1963 | France | 280/620 |
| 2645037 | 10/1990 | France | 280/14.2 |
| 535818 | 10/1931 | Germany | 280/636 |
| 2723864 | 11/1978 | Germany . | |
| 9112058 | 8/1991 | WIPO | 280/633 |

*Primary Examiner*—Brian L. Johnson

*Attorney, Agent, or Firm*—Howard J. Greenwald; James F. Mudd

[57] ABSTRACT

A ski binding for removably attaching a boot to a ski. The ski binding contains a base plate, a first mounting stud attached to the base plate, a second mounting stud attached to the base plate, a binding base removably and pivotally attached to the first mounting stud. The ski binding is adjustably and releasably attached to the boot.

18 Claims, 8 Drawing Sheets

PIVOTAL AND ADJUSTABLE SLALOM MONASKI BINDING

FIELD OF THE INVENTION

An adjustable, release-type ski binding is disclosed.

BACKGROUND OF THE INVENTION

Monoskis, also often referred to as "slalom skis," allow a skier to ski on one ski. Various devices for attaching boots to moniskis are well known to those skilled in the art.

By way of illustration, U.S. Pat. No. 4,008,908 of William M. Pierson discloses a two piece snow ski binding comprising a toe piece and a heel piece. The device of this patent does not bind the rear boot in place onto the ski, and thus it only permits lateral and downward forces to be applied to the ski by the skier. Consequently, it does not afford the degree of control demanded by many expert skiers.

By way of further illustration, a monoski with two ski bindings positioned on pedestals inclined in opposite directions, one behind the other, is described in West German patent publicaton Offenlegungsschrift DE 2723-864 A1 of Roland Kittmann et al., published on Nov. 30, 1978. The monoski of this latter publication is cumbersome and often does not readily allow a skier to easily and simultaneously release his boots from both bindings.

It is an object of this invention to provide a ski binding which can be mounted aft onto a sinlge standard ski equipped with a standard release binding and, after being so mounted, which will afford a skier substantially more control than prior art monoskis while readily allowing the skier to simultaneously release from both of the slalom ski bindings.

It is another object of this invention to provide a ski binding which can readily be mounted onto or detached from a standard ski to afford a skier the flexibility of skiing with either one or two standard skis.

It is yet another object of this invention to provide a ski binding which, when mounted upon a ski, affords a skier the ability to laterally pivot the rear of his boot to a limited extent.

It is yet another object of this invention to provide a ski binding which is comprised of at least two adjustment means for varying the fit of the binding to a boot.

SUMMARY OF THE INVENTION

In accordance with this invention, there is provided a ski binding comprised of a base plate, a plurality of mounting studs attached to said base plate, a binding base removably and pivotally attached to one of said mounting studs, and means for adjustably and releasably attaching said binding to a boot.

BRIEF DESCRIPTION OF THE DRAWINGS

Applicants' invention will be illustrated by reference to the specification and the following drawings, in which like reference numerals refer to like elements, and in which.

DESCRIPTION OF THE PREFERRED EMBODIMENTS

Figure 1:
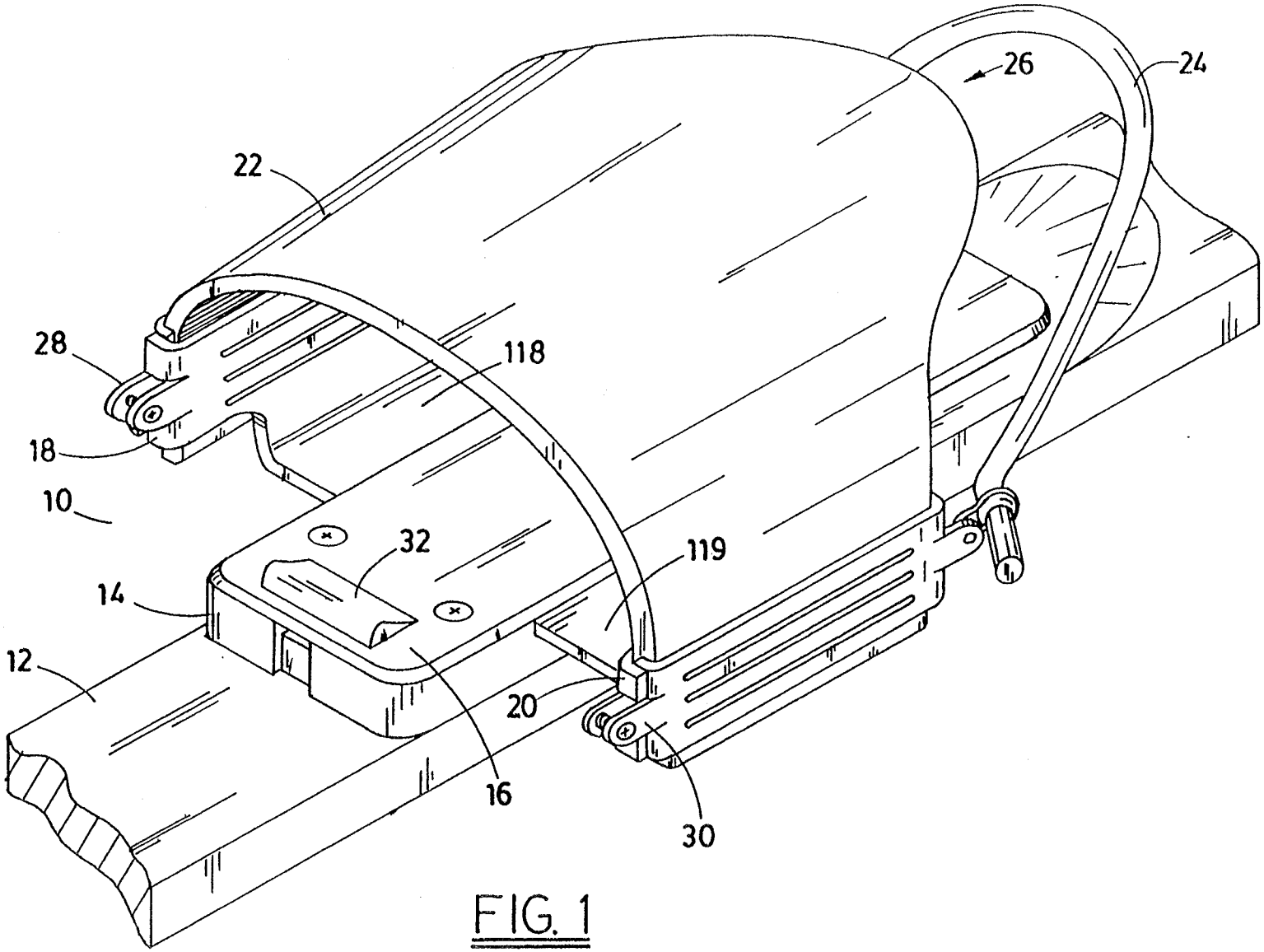
FIG. 1 is a perspective view of one preferred embodiment of applicants' ski binding mounted upon a ski.

FIG. 1 is a perspective view of one preferred embodiment of applicants' ski binding. Referring to FIG. 1, it will be seen (especially by reference to subsequent Figures, such as FIGS. 3 and 5) that ski binding 10 is releasably mounted to ski 12.

In the preferred embodiment depicted in FIG. 1, ski binding 10 is comprised of binding base 14, top plate 16, boot adjustment bracket assemblies 18 and 20, elastic boot cup 22, and elastic heel strap 24. In using ski binding 10, a boot (not shown) is inserted between top plate 16 and boot cup 22, and between adjustment bracket assemblies 18 and 20, in the direction of arrow 26. Thereafter, elastic heel strap 24 is stretched over the heel (not shown) of the boot, and adjustment bracket assemblies 18 and 20 are used to adjust the width of such adjustment bracket assemblies. The tension on boot cup 22 may be adjusted by means of clamps 28 and 30, which form part of adjustment bracket assemblies 18 and 20, respectively. The adjustment bracket assemblies 18 and 20 also comprise angle brackets 118 and 119, respectively.

Referring again to FIG. 1, it will be seen that top plate 16 is comprised of a boot retention cam 32 which cooperates with a mating cam (not shown in FIG. 1, but see FIG. 8) in a boot plate (not shown in FIG. 1) recessed within the boot sole. This arrangement is more clearly illustrated in FIG. 8.

Figure 2:
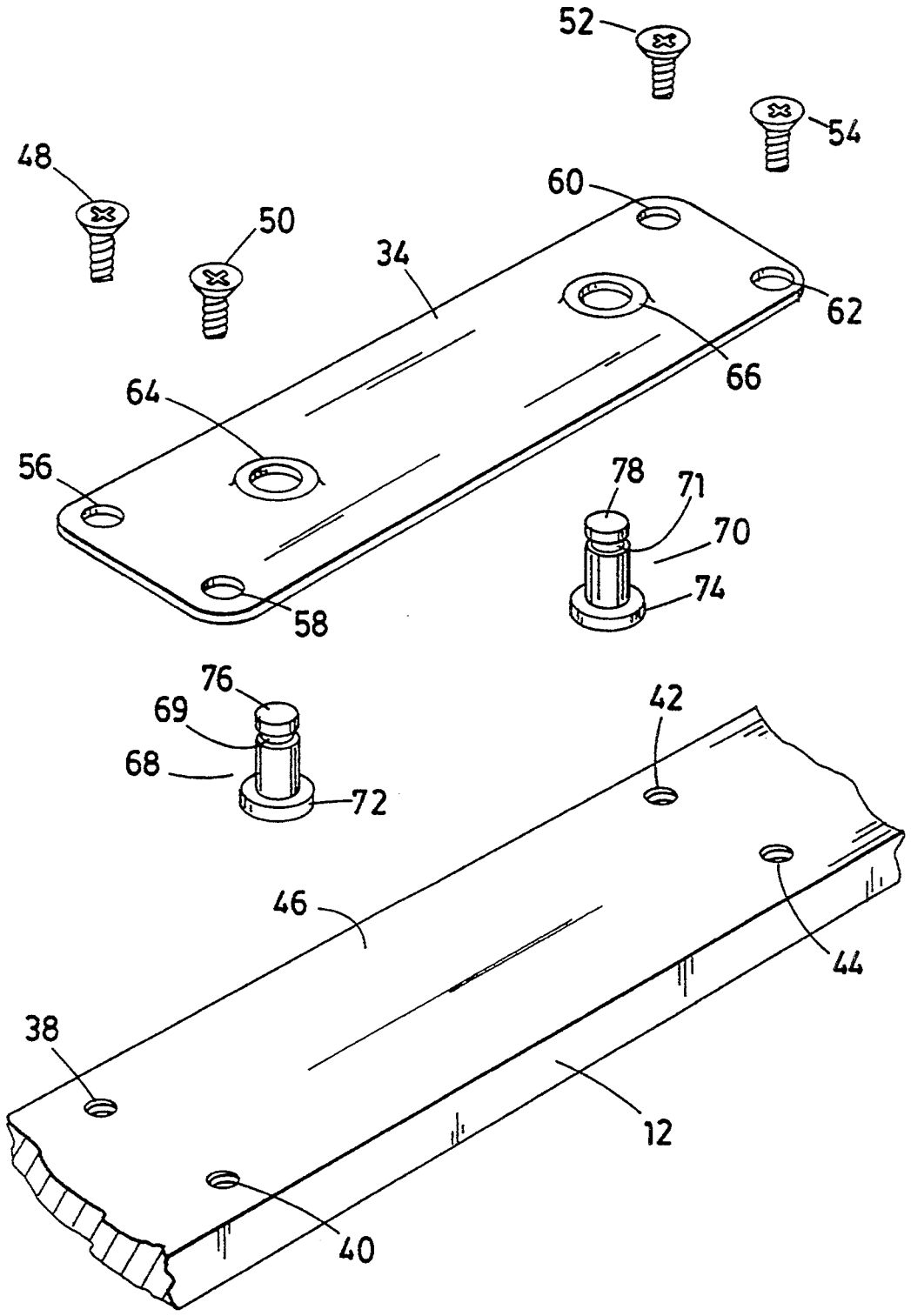
FIG. 2 is an exploded view showing the base plate and the mounting studs of the ski binding of FIG. 1 and how they cooperate to attach such binding to the ski.

FIG. 2 illustrates one preferred means for attaching a base plate 34 to ski 12. Referring to FIG. 2, it will be seen that ski 12 has a multiplicity of orifices 38, 40, 42, and 44 that are drilled into the top surface 46 of ski 12, and fasteners 48, 50, 52, and 54 are inserted through orifices 56, 58, 60, and 62 of the base plate 34 and into orifices 38, 40, 42, and 44.

Referring again to FIG. 2, it will be seen that base plate 34 also is comprised of orifices 64 and 66 which are adapted to receive mounting studs 68 and 70. As will be apparent to those skilled in the art, when mounting studs 68 and 70 are fully inserted through orifices 64 and 66, shoulders 72 and 74 of such mounting studs will be captured by the underside (not shown) of base plate 34. Thus, such underside of base plate 34, in one embodiment (not shown) has a recess formed in it to accept such shoulder of the mounting stud.

The base plate 34 may be constructed out of any material which will afford it the necessary degree of strength. In one embodiment, base plate 34 consists essentially of steel, and it is a steel stamping.

In one preferred embodiment, base plate 34 has a thickness of from about 0.08 to about 0.1 inches, a width of at least about 2.5 inches, and a length of from about 5 to about 8 inches.

The mounting studs 68 and 70 also preferably consist essentially of steel. In one preferred embodiment, the shoulders 72 and 74 each have a diameter of from about 0.6 to about 0.8 inches, and the shanks 76 and 78 each have a diameter of from about 0.4 to about 0.6. It is preferred that the diameter of each of shoulders 72 and 74 be at least about 1.05 times as great as the diameter of shank. It is more preferred that the diameter of the shoulder be from about 1.1 to about 1.25 times as great as the diameter of the shank.

Figure 3:
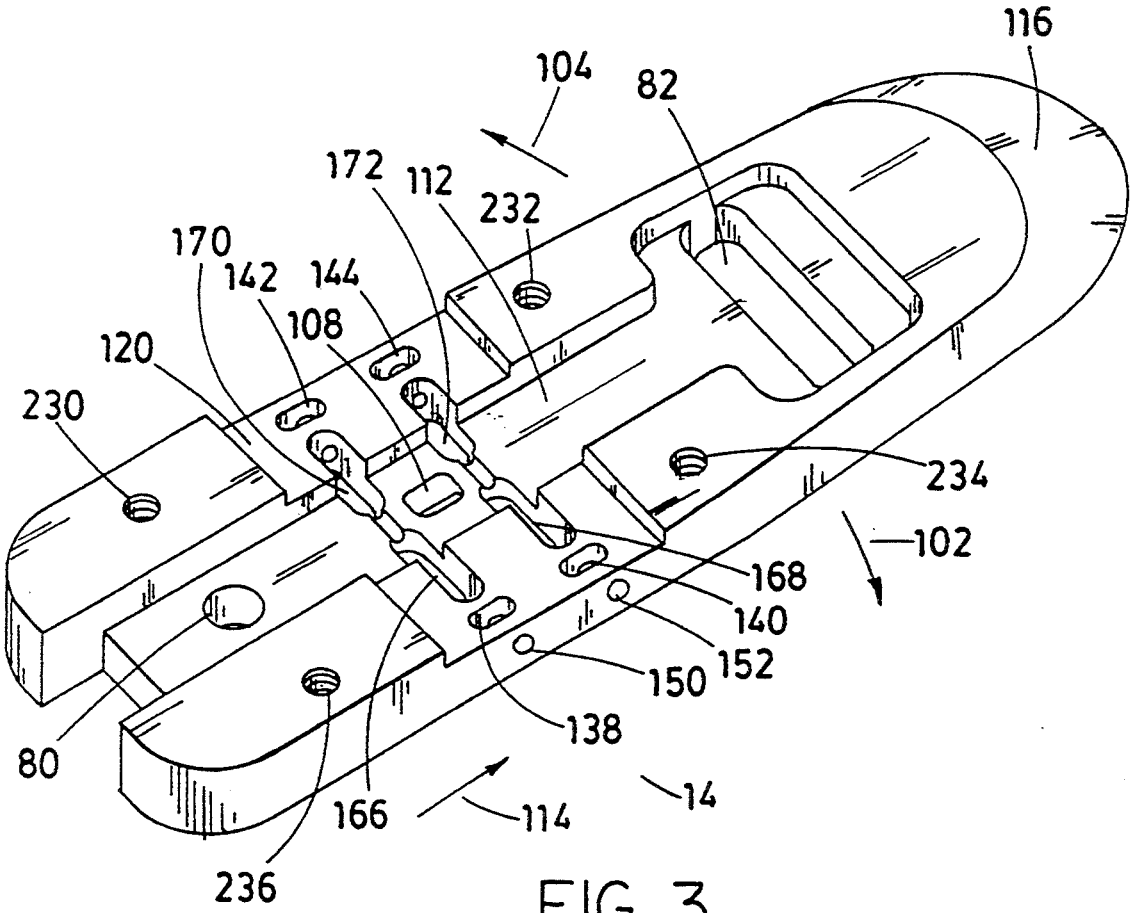
FIG. 3 is a perspective view of the binding base of the ski binding of FIG. 1.

FIG. 3 is a perspective view of binding base 14. It will be seen that binding base 14 is comprised of orifice 80 and slot 82 through which mounting studs 68 and 70, respectively, may extend. These mounting studs then may be engaged by the engagement plunger depicted in FIG. 5.

Figure 5:
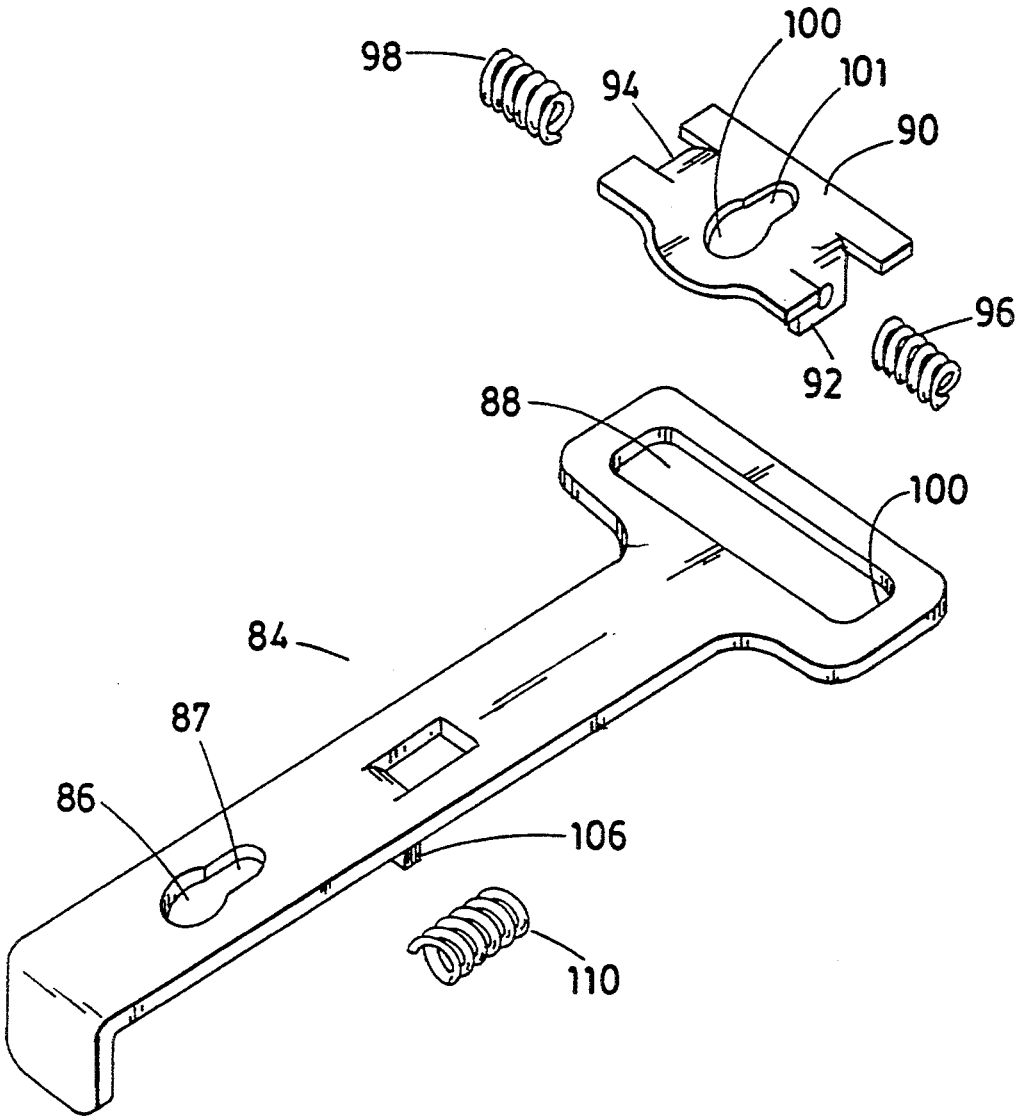
FIG. 5 is an exploded view of a preferred means of disengaging the binding base of FIG. 3 from the base plate of FIG. 2.

Referring to both of FIGS. 3 and 5, it will be seen that engagement plunger 84 also is comprised of an orifice 86 and a slot 88, through which mounting studs 68 and 70, respectively, may extend. Lateral centering engagement bracket 90 (see FIG. 5) is movably disposed within slot 88. Fingers 92 and 94 of bracket 90 are engaged by centering springs 96 and 98.

Springs 96 and 98 are disposed within slot 82 of binding base 14 (see FIG. 3), downwardly extending fingers 92 and 94 are also disposed within slot 82.

The mounting stud 70 extends through an orifice 100 of the lateral centering engagement bracket 90 (see FIG. 5). A portion of orifice 100 preferably has a width which is larger than the diameter of the shank 78 of mounting stud 70 to allow the insertion of such shank and another portion which is narrower than the diameter of the shank 78 to allow retention of the mounting stud into the orifice.

Referring again to FIG. 2, it will be seen that each of the mounting studs 68 and 70 is comprised of a groove 69 and 71 which will be engaged by the slotted portion 87 of orifice 86, and the slotted portion 101 of orifice 100 (see FIG. 5). When the plunger 84 is moved so that the mounting studs 68 and 70 are no longer disposed within portions 87 and 101 of orifices 86 and 100, the mounting plunger 84 and the binding base assembly may be removed from the ski 12.

The lateral centering engagement bracket 90 is free to move within slot 88 in either lateral direction.

Referring again to FIGS. 3 and 5, the stud 68 extends through orifice 80 of the binding base 14 and through the orifice 86 of the engagement plunger 84. It will be apparent to those skilled in the art that, because of this arrangement, the binding base 14 will be free to rotate in the direction of either arrows 102 or 104 (see FIG. 3). Thus, a skier using applicant's preferred binding has a degree of rotational flexibility (and consequent control of his skis) which is not present with prior art ski binding systems.

Referring again to FIG. 5, it will be seen that engagement plunger 84 is comprised of a downwardly extending finger 106 which is disposed within slot 108 of binding base 14 (see FIG. 3). Spring 110 (see FIG. 5) is also disposed within slot 108. Thus, when engagement plunger 84 is mounted on binding base 14 within recess slot 112, a force may be exerted in the direction of arrow 114 to move plunger 84 rearwardly against spring 110; and the binding base 14 assembly may then be removed from the ski 12 (not shown)

Referring again to FIG. 3, it will be seen that binding base 14 is preferably comprised of a boot engagement ramp section 116 to facilitate engagement of the boot (not shown) into the binding 10. Although, in the preferred embodiment of FIG. 3, the ramp section 116 is integrally formed with binding base 14, it will be apparent to those skilled in the art that the ramp section 116 may be separately formed and independently attached to the ski 12.

Binding base 14 is preferably an integral structure which is preferably comprised of, or consists essentially of, a relatively high-strength material, such as aluminum, steel, or plastic.

In one preferred embodiment, the binding base 14 consists essentially of a plastic material which may be readily injection molded and which possesses good physical properties (such as impact resistance) at low temperatures. Thus, e.g., one may use a polyamide-imide such as "TORLON" (which is sold by Amoco Performance Products), "ZYTEL" (a polyamide made by the E.I. DuPont de Nemours and Company), "LEXAN" (a polycarbonate manufactured by the General Electric Company), and the like.

Figure 4:
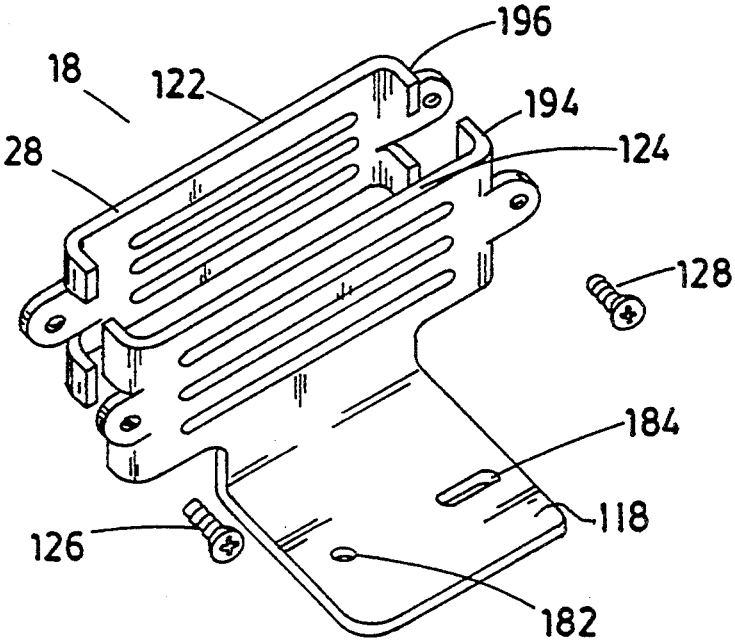
FIG. 4 is a perspective view of the boot adjustment bracket of the ski binding of FIG. 1.

FIG. 4 illustrates the preferred boot adjustment bracket assembly 18 used in the binding of FIG. 1. Referring to FIG. 4, it will be seen that bracket assembly 18 is comprised of a clamp 28 and, preferably integrally formed therewith, a bracket 118. In a similar manner, clamp 30 and angle bracket 119 are employed on the opposite side of the binding as parts of adjustment bracket assembly 20.

The bracket 118 is preferably slidably disposed within recessed slot 120 which forms part of the binding base 14 (see FIG. 3).

After the desired degree of fit between the elastic boot cup 22 and the boot (not shown) has been obtained, the elastic boot cup 22 may be clamped between jaws 122 and 124 of clamp 28 and, thereafter, the clamp 28 may be tightened by means of fasteners 126 and 128. The other clamp 30 (not shown) may be fastened in a similar fashion.

As will be appreciated by those skilled in the art, the elastic boot cup 22 provides an important advantage to applicants' binding which was not readily afforded by prior art ski bindings: it enables a skier to lift his heel and also exert force upwardly against the cup to unweight the ski so that it can be turned quickly. Furthermore, the elasticity of boot cup 22 is important in that it allows the skier to move the full length of the boot from toe to heel, pivoting forward on the toe, so that his leg from knee downward can be bent forward with ease.

Figure 6:
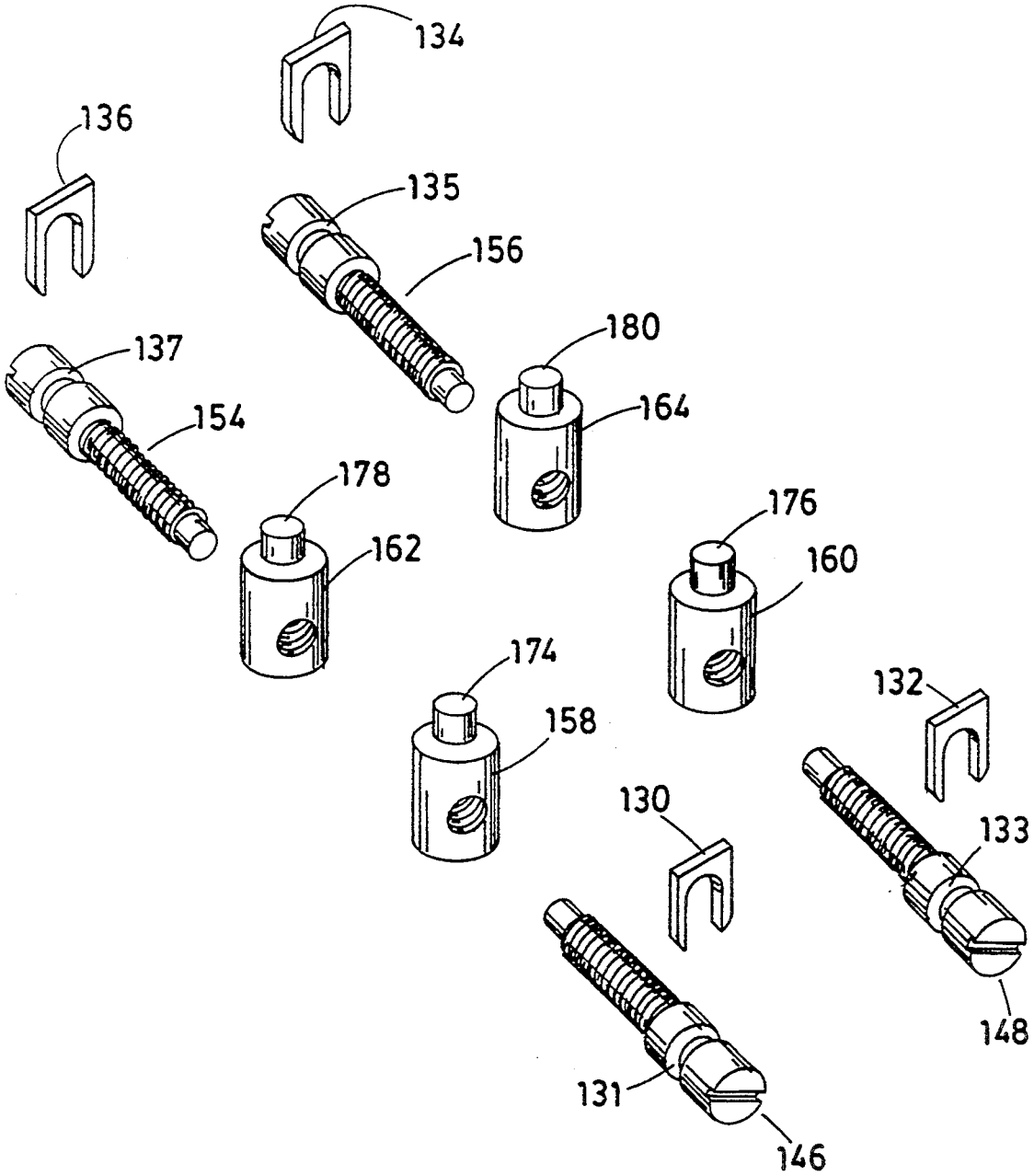
FIG. 6 is an exploded view of a means for adjusting the boot adjustment bracket of FIG. 4 to accommodate different sized boots.

One preferred means for adjusting the distance between clamp 28 and clamp 30 is shown schematically in FIGS. 3 and 6. Referring to these Figures, it will be seen that retention clips 130, 132, 134, and 136 may be disposed within slots 138, 140, 142, and 144 in the binding base 14 (see FIG. 3). Screws 146 and 148 (see FIG. 6) may be inserted through orifices 150 and 152 (see FIG. 3); screws 154 and 156 (see FIG. 6) may be inserted through corresponding orifices (not shown) in the binding base 14. It will be seen that the clips 130, 132, 134, and 136 each engage a groove 131, 133, 135, or 137 and thereby provide a ground point for the adjustment screws.

Posts 158, 160, 162, and 164 (see FIG. 6) are movably disposed within slots 166, 168, 170, and 172 of binding base 14 (see FIG. 3). Screws 146, 148, 150, and 152 engage the internally threaded orifices of the adjustment posts 158, 160, 162, and 164 and, when such screws are rotated, cause such adjustment posts to move laterally within the slots 166, 168, 170, and 172.

The posts 158, 160, 162, and 164 are each comprised of a reduced diameter section 174, 176, 178, and 180. Each of these reduced diameter sections communicates with a corresponding orifice in the bracket of the boot adjustment bracket assembly. Thus, referring again to FIGS. 4 and 6, reduced diameter sections 178 and 180 (see FIG. 6) communicate with orifices 182 and 184 of bracket 118 (see FIG. 4). As will be appreciated by those skilled in the art, by rotating screws 154 and/or 156, one may cause bracket assembly 20 to move laterally within recess slot 120.

Figure 7:
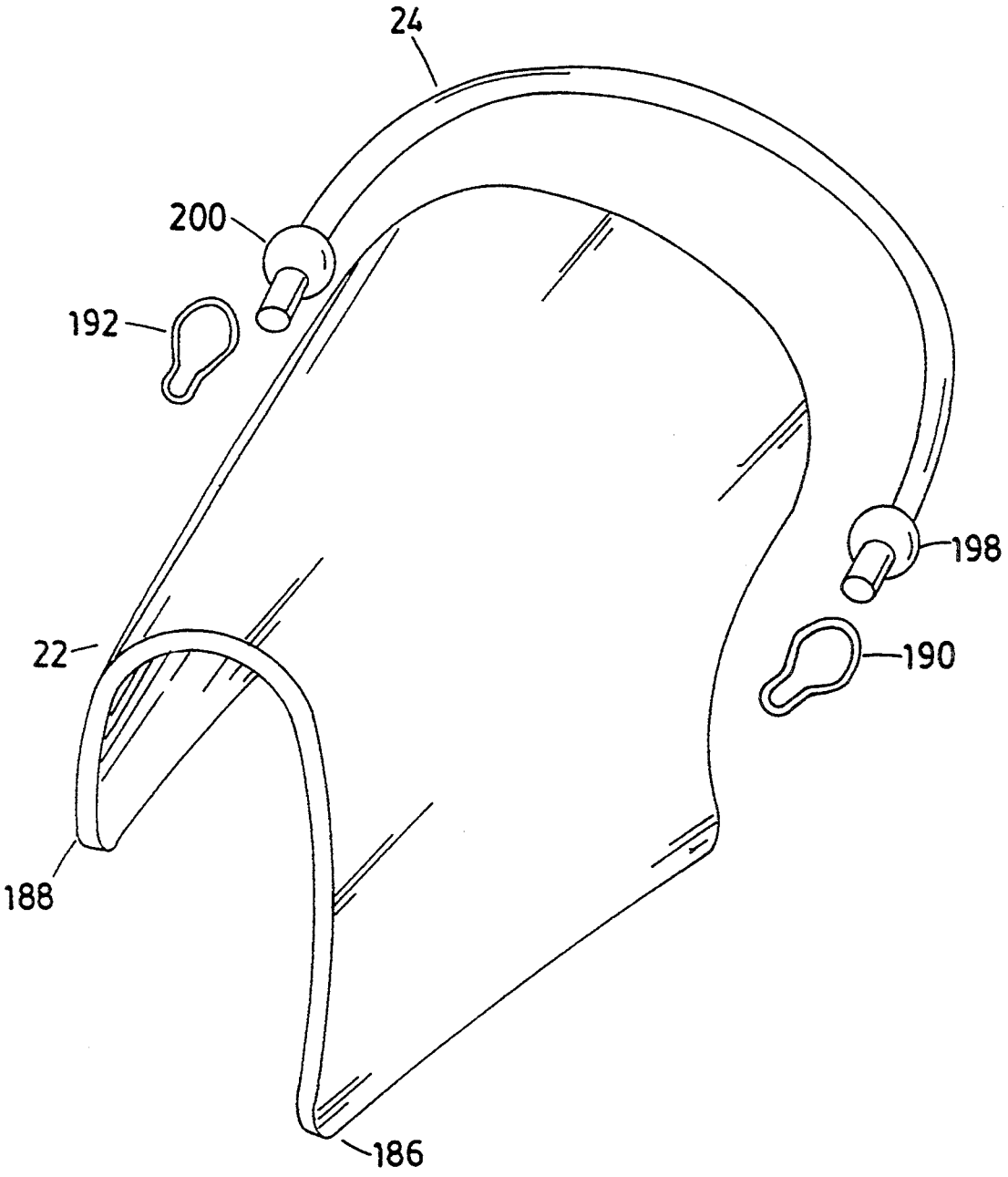
FIG. 7 is a perspective view of the elastic boot cup and elastic heel strap of the ski binding of FIG. 1.

FIG. 7 is a perspective view of the elastic boot cup 22 and the elastic heel strap 24 used in the binding 10 of FIG. 1. The term elastic, as used in this specification, refers, refers to a substance that resumes its original shape after a force causing distortion is removed.

In one preferred embodiment, the elastic boot cup 22 consists essentially of an elastomeric material, such as natural and/or synthetic rubber.

As will be apparent to those skilled in the art, the ends 186 and 188 of boot cup 22 may be pulled through the jaws of the clamping mechanism (see, e.g., jaws 122 and 124 of FIG. 4) to the desired extent prior to clamping such ends.

Referring again to FIG. 7, the elastic heel strap 24 (which may also, in one embodiment, consist essentially of an elastomeric material) may be inserted through clips 190 and 192, and such clips may then be affixed to lateral adjustment bracket assemblies 18 and 20; as will be seen from FIG. 7, the ends of elastic strap 24 have an enlarged, ball-shaped section (see sections 198 and 200) which engage the clips 190 and 192 and are captured by the clips.

As will be apparent to those skilled in the art, the fact that heel strap 24 is flexible affords two distinct advantages. In the first place, heel strap 24 holds the skier's boot in the binding securely so that, when the skier is in rough terrain, his foot is not likely to disengage from the binding; however, if the skier falls, the heel strap 24 stretches and, under this more extreme circumstance, allows the skier's foot to be released from the toe piece.

Although the maximum interior dimension of the clips 190 and 192 is smaller than the maximum dimension of the sections 198 and 200, due to their elastic properties, such sections may be forced through such clips.

Thus, for example, referring to FIGS. 7 and 4 (and also to FIG. 1), clip 192 may be disposed between ears 194 and 196 of clamp 28 prior to the time such clamp is closed by fasteners 128 and 126.

Figure 8:
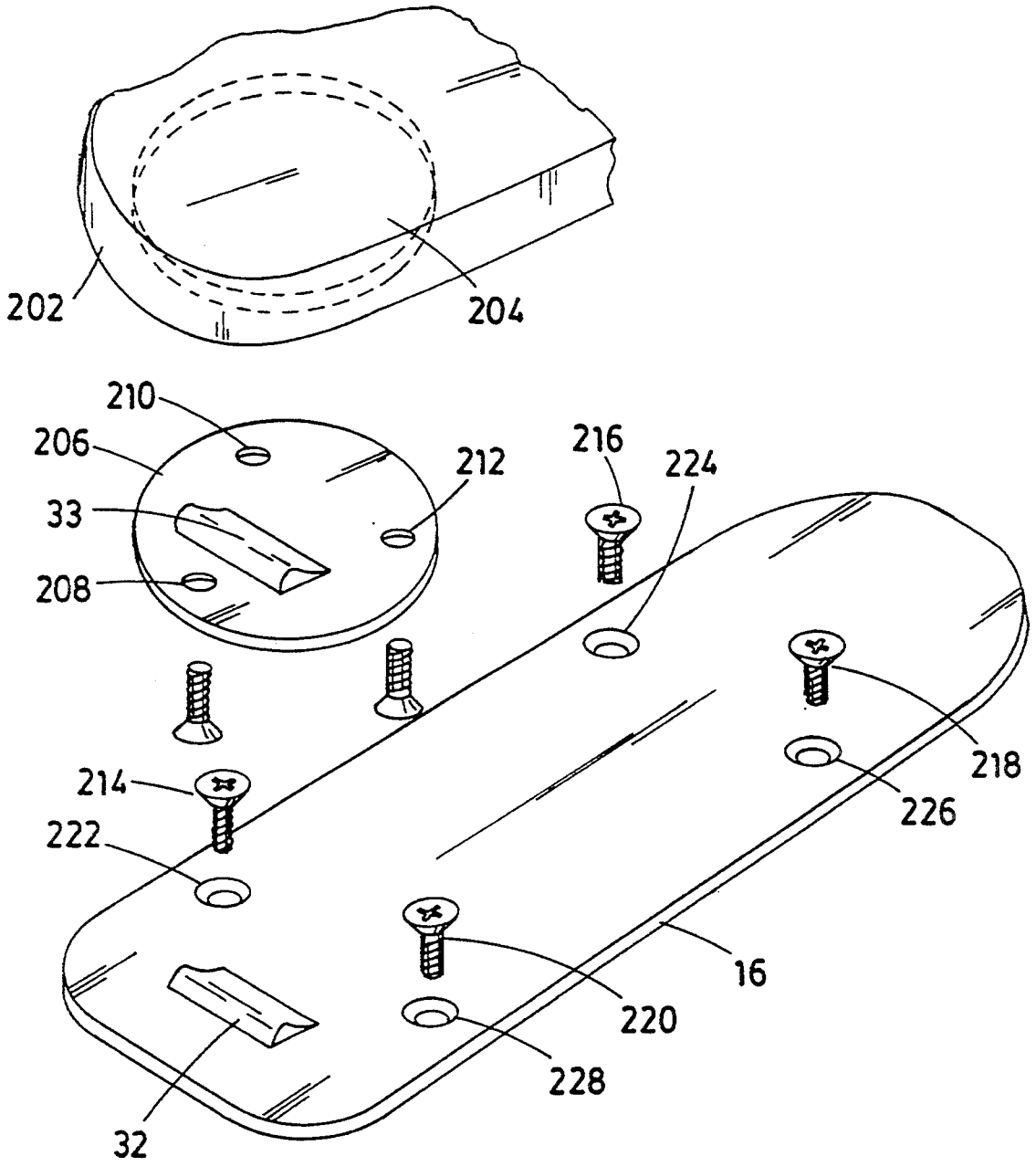
FIG. 8 is an exploded view of the top plate of the ski binding of FIG. 1 showing its cooperation with a retainer plate of a boot.

FIG. 8 illustrates one preferred means of readily attaching one end of the ski binding 10 to a boot 202. Referring to FIG. 8, and in the preferred embodiment depicted therein, it will be seen that boot 202 is preferably comprised of a recess 204 (shown in phantom) which is adapted to receive retention plate 206. Retention plate 206 is comprised of orifices 208, 210, and 212 which, with the use of suitable fasteners, allow its attachment to the recess 204 within boot 202.

The retention plate 206 is comprised of a mating cam 33 which is adapted to engage cam 32, thereby removably limiting the motion of boot 202 relative to top plate 16. When the boot 202 is pressed downwardly onto the top plate 16, then the combination of mating cams 32 and 33 restrain the boot 202 from rearward movement under normal skiing operations. However, when the skier wishes to (or needs to) disengage the boot 202 from the top plate 16, he may rotate the boot 202 upwardly around its tip (not shown), thereby stretching elastic members 22 and 24, and permitting disengagement of mating cams 32 and 33 so that boot 202 may be released from its binding 10.

Referring to FIGS. 8 and 3, top plate 16 may be mounted to binding base 14 by inserting fasteners 214, 216, 218, and 220 though orifices 222, 224, 226, and 228 of top plate 16 (see FIG. 8) and into orifices 230, 232, 234, and 236 of binding base 14. The top plate 16 retains all of the mechanism (such as plunger 84, adjustment bracket assemblies 18 and 20, and the other springs and adjustment means described hereinabove) within the binding base.

Figure 9:
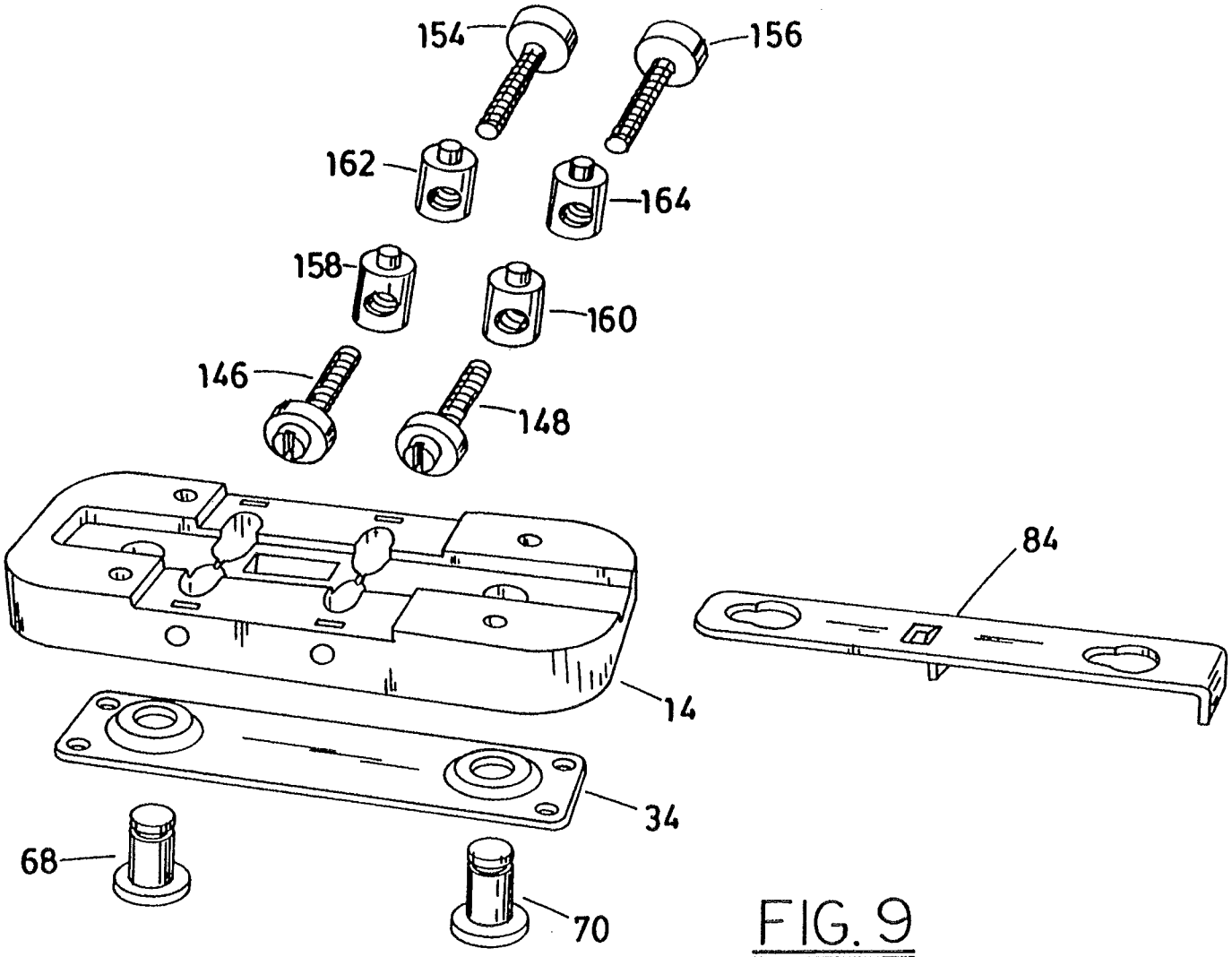
FIG. 9 is an exploded view of another preferred embodiment of applicants' ski binding.

FIG. 9 is an exploded view of another preferred embodiment in which similar elements are numbered in the same manner as in FIGS. 1–8.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A ski binding for removably attaching a boot to a ski, wherein said ski binding is comprised of a base plate which is attachable to said ski, a first mounting stud attached to said base plate, a second mounting stud attached to said base plate, a binding base, means for removably and pivotally attaching said binding base to said first mounting stud, and means connected to said binding base for adjustably and releasably attaching said ski binding to said boot, such that said binding base is free to rotate and said binding has rotational flexibility to allow a user to control the ski during use.

2. The ski binding as recited in claim 1, wherein ski binding is comprised of an elastic member attached to said means for adjustably and releasably attaching said ski binding to said boot.

3. The ski binding as recited in claim 2, wherein said elastic member is an elastic boot cup.

4. The ski binding as recited in claim 3 wherein said means for adjustably and releasable attaching said ski binding to said boot is comprised of a first substantially L-shaped bracket, and a second substantially L-shaped bracket and a means for engaging said L-shaped brackets to said binding base.

5. The ski binding as recited in claim 4, wherein said ski binding is comprised of an elastic heel strap which is connected to said first substantially L-shaped bracket and to said second substantially L-shaped bracket.

6. The ski binding as recited in claim 5 wherein said ski binding rotational flexibility further includes means for maintaining said boot substantially in the center of said ski binding.

7. The ski binding as recited in claim 6, wherein said means for maintaining the pivoting binding base substantially in the center of said ski binding is comprised of a first centering spring, a second centering spring, and an engagement bracket disposed between and contacted by said first centering spring and said second centering spring wherein the engagement bracket engages the second mounting stud of the base plate.

8. The ski binding as recited in claim 7, wherein said ski binding is comprised of a top plate attached to said binding base.

9. The ski binding as recited in claim 8, wherein said top plate is comprised of a first cam surface.

10. The ski binding as recited in claim 9, wherein said ski binding is comprised of a retention plate adapted to be attached to said boot.

11. The ski binding as recited in claim 10, wherein said retention plate is comprised of a second cam surface which is substantially congruent with said first cam surface.

12. The ski binding as recited in claim 11, wherein said binding base is comprised of a top surface within which a vertically-extending recess is disposed.

13. The ski binding as recited in claim 12, wherein said ski binding is comprised of an engagement plunger movably connected to said binding base.

14. The ski binding as recited in claim 13, wherein said engagement plunger is movably disposed within said vertically-extending recess.

15. The ski binding as recited in claim 14, wherein said engagement plunger is contiguous with a spring disposed within a first slot within said binding base.

16. The ski binding as recited in claim 15, wherein engagement plunger is comprised of a first orifice in which is disposed said first mounting stud.

17. The ski binding as recited in claim 16, wherein said engagement plunger is comprised of a second slot in which said second mounting stud is disposed.

18. The ski binding as recited in claim 17, wherein said engagement bracket is disposed in said second slot.

* * * * *